US005083870A

United States Patent [19]

Sindelar et al.

[11] Patent Number: 5,083,870

[45] Date of Patent: Jan. 28, 1992

[54] ASPHALT PLANT WITH SEGMENTED DRUM AND ZONAL HEATING

[76] Inventors: Robert A. Sindelar, 606 E. South Street, Beaver Dam, Wis. 53916; Donald J. Alexander, 125 Webster St., Beaver Dam, Wis. 53916

[21] Appl. No.: 643,202

[22] Filed: Jan. 18, 1991

[51] Int. Cl.[5] ..... B28C 5/46

[52] U.S. Cl. ..... 366/25; 34/137; 366/149; 432/110

[58] Field of Search ..... 366/22, 23, 24, 25, 366/144, 147, 149, 145; 34/135, 137; 432/110, 118

[56] References Cited

U.S. PATENT DOCUMENTS

| | | | |
|---|---|---|---|
| 4,395,129 | 7/1983 | Musil | 366/25 |
| 4,910,540 | 3/1990 | Murray | 366/23 |
| 4,954,995 | 9/1990 | Marconnet | 366/25 |

*Primary Examiner*—Robert W. Jenkins
*Attorney, Agent, or Firm*—Lathrop & Clark

[57] ABSTRACT

A blacktop plant has a rotatable cylindrical mixing drum. The drum is disposed within a chamber which is divided into two chambers by a baffle through which the drum penetrates. The forward section of the heating chamber preheats the material which is fed into the drum for heating and recovers latent heat from the water vapor in the heating chamber exhaust. The second chamber has a multiplicity of burners mounted beneath the drum and aligned with the drum axis. Each heater is partially baffled from adjacent heaters by zonal baffles. The heaters are rotatively mounted to a frame upon which the heating chamber and drum are mounted and may be rotated to change the angle with which the burner flame impinges upon the drum. Quadrant plates partition the drum along its axis to form the drum into four equal quadrants. The quadrant plates have drop slots which allow the material to pass from one quadrant to another. The material in the drum is heated in counterflow by the combustion gases from the burners in the heating section of the chamber. The blacktop plant has flat stack scrubber units disposed along the sides of the chamber for cleaning the exhaust gases with counterflowing spray water. The plant is adapted for mounting on a trailer for movement over the surface to be paved. The chamber is insulated and allows the use of microwave energy for heating the asphalt and sound energy for cleaning the mixing drum.

36 Claims, 8 Drawing Sheets

ASPHALT PLANT WITH SEGMENTED DRUM AND ZONAL HEATING

FIELD OF THE INVENTION

The present invention relates generally to an apparatus for manufacturing asphalt paving compositions, and relates more specifically to asphalt plants having rotary drums.

BACKGROUND OF THE INVENTION

Apparatus for manufacturing asphalt paving are well known. Asphalt pavement, more commonly known as blacktop, is produced by mixing asphalt with sand and gravel and heating the mixture to a temperature around 300° F. Asphalt is the black material which binds the aggregate together. Asphalt is derived from crude oil along with the more familiar hydrocarbons of gasoline, kerosene and heating oil. At the paving temperature of 250° to 350°, asphalt is a viscous liquid which coats the aggregate and sand and, upon cooling, binds the aggregate and sand together to form a tough wear-resistant pavement known as blacktop.

Asphaltic paving material may also be manufactured from recycled material in whole or in part. Recycled blacktop, also known as Recycled Asphalt Pavement or "RAP", is broken up into small chunks and heated. Where aging of the recycled pavement has removed important components called volatiles from the asphalt, these may be replaced with light asphalts or rejuvenating fluid containing a mixture of lighter hydrocarbons to obtain the design percentage of asphalt in the mix.

Heating recycled asphalt presents a problem when designing an asphaltic pavement plant. The reused asphalt paving material must be heated to soften and melt the blacktop so it may be made workable to enable it to be modified to obtain a desired standard. However, if the asphalt is subjected to high temperatures in the heating process such as by exposure to direct flame, the asphalt will char. Charring of the asphalt is undesirable because it produces smoke and polluting fumes and reduces the ability of the asphalt to cement the aggregate together.

One method of producing asphaltic aggregates employing recycled blacktop is to heat virgin aggregate, which is not subject to charring, to 600° or 700° F., then mixing it with the RAP. The mixture of virgin aggregate and RAP produces a mixture with a desirable paving temperature of 250° to 350° F. which is mixed with sufficient asphalt to form the finished paving material. This approach has two drawbacks: 1) even 600° or 700° F. aggregate results in some charring and smoking of the RAP. Secondly, this limits the percentage of reused blacktop to 50% or 60% of the total mixture. However, it is desirable for reasons of cost and oil conservation to process mixtures containing up to 100% RAP.

Another desirable attribute of an asphalt paving plant is a high production rate to meet requirements for modern paving projects which require at least 100 tons per hour and preferrably 400 to 600 tons per hour. Conventional paving plants achieve high production rates by employing rotating drum heaters which employ a large centrally located burner disposed in one end of the drum which heats the virgin aggregate or aggregate and RAP as they move down the axis of the rotating drum. This type of asphalt plant can have the undesirable effect of overheating the asphalt in the recycled material.

Known methods of dealing with the overheating of the recycled material and any asphalt which is added to the aggregate is to add these materials to the drum away from the heated end. This limits the amount of recycled material which can be added and still reach a final temperature of around 300° F. in the asphalt paving, it also may subject the new and recycled asphalt to excess heating.

One known asphaltic plant places a smaller inner drum around the burner at the end of the drum. Aggregate is placed in the smaller central drum and recycled material is placed between the inner and outer drum where it is preheated. This type of asphalt plant cannot process 100% recycled material.

Another known plant utilizes pipes which penetrate the drum heater along its axis and through which the heating gases are made to flow. Aggregate and asphalt are introduced to the drum through one end and the drum is rotated to mix and heat the asphaltic composition. The finished asphalt composition is withdrawn from the opposite drum end. The apparatus includes a heating chamber at one end of the drum, which communicates with the pipes penetrating the interior of the drum. This type of plant may include means for at least a portion of the unburned hydrocarbon volatiles released from the heated composition to be directed into the heating chamber for further combustion. Drums of this type suffer from differential thermal contraction because the drum penetrating pipes are much hotter than the drum. The penetrating pipes which carry gases directly from the combustion chamber can lead to charring of the asphalt. The high temperature of the pipes and the general arrangement of the pipes leads to excessive build-up of asphaltic material which adheres to the pipe surfaces. Drums of this type are difficult to clean because of the limited access to the drum interior.

To rapidly heat large amounts of asphalt paving, current asphaltic plants employ high temperatures to effect rapid heating of the asphalt paving mixture. The use of high temperature leads to the undesirable results of asphalt charring or smoking. Existing drum heaters cannot supply the large quantity of asphalt paving without the use of high temperature and the resulting problems.

A further problem with prior art drum mixers is that they are of limited thermal efficiency. In some asphaltic drum heaters, the design causes the air leaving the plant to be hotter than the finished asphalt paving material wherein considerable heat escapes with the exhaust gases.

Known drum mixer are not designed to be easily insulated to prevent the loss of heat from the asphaltic plant.

Further, virgin aggregate and recycled blacktop which are processed by drum mixers contain water which must be evaporated. The evaporation of water in the feed material for asphaltic plants may absorb as much as half the heat used in preparing the asphalt pavement. Prior art drum mixers provide no means for recovering the latent heat required to evaporate this water.

A further problem with prior art drum mixers is that they require a dust collection system such as a bag house, a wet washer or cyclone separator. Further, prior art does not show how to integrate the dust collection system with the asphaltic plant.

The requirement for a separate dust collecting system is particularly burdensome where the asphaltic drum mixer is used as part of a paving train. A paving train is a number of vehicles traveling in train fashion, one after the other, which perform all the necessary steps required for resurfacing a road. The requirement for an additional pollution-control, dust-collecting vehicle in the paving train adds considerable expense, but this problem has not been addressed by prior art drum mixers.

Yet another difficulty with prior art asphalt plants employing drum heaters is that they are not sufficiently adjustable and do not include sufficient sensors to allow the manufacture of asphalt paving to be controlled in an optimal manner through the use of a programmable controller or computer.

A still further problem with prior art drum mixers is that virgin aggregate causes excessive wear of the drum liner before it reaches the section of the drum where asphalt is added which supplies a lubricating effect.

Finally, prior art drum mixers are not adaptable to the use of microwave heating or other forms of radiant energy because they are not enclosed and separated from the surrounding environment.

What is needed is an asphalt plant having a rotating drum which can efficiently and rapidly heat 100 to 600 tons per hour of asphaltic aggregate without subjecting the asphaltic aggregate to excessively high temperatures which result in charring or smoke. Further, an asphalt plant is needed capable of processing 100% recycled blacktop and employing an apparatus for recovering latent heat from the water evaporated from the aggregate. An asphaltic plant is needed which is contained within a chamber and can be adapted for optimal computer control.

SUMMARY OF THE INVENTION

The blacktop plant of this invention employs a rotatable cylindrical mixing drum. The drum is disposed within a chamber. The chamber is divided into two sections by a baffle through which the drum penetrates. The forward, or preheat section, of the heating chamber preheats the material which is fed into the drum for heating and recovers latent heat from the water vapor in the heating chamber exhaust. The second chamber, or heating chamber, has a multiplicity of burners mounted beneath the drum and along the drum's axis. These heaters are partially baffled from adjacent heaters by zonal baffles. Zonal baffles do not extend completely around the rotating drum, but rather serve to create distinct heating zones spaced along the bottom of the heating chamber. The heaters are rotatively mounted to a frame upon which the heating chamber and the drum are mounted. The heaters may be rotated to change the angle at which the burner flame impinges upon the drum.

The drum is supported by flanged rollers which are mounted upon the support frame. The support frame may have wheels so that the asphaltic plant may be used in mobile applications.

The drum is caused to rotate by a circumferential drive sprocket which is driven by a transmission sprocket which is connected to a variable speed transmission driven by an electric motor which is located outside the heating chamber and is isolated thermally from the heating chamber.

The chamber has a material infeed end disposed within the forward or preheat section. The aggregate or RAP is fed by a tube which penetrates the infeed end wall of the chamber and empties into the infeed end of the drum. The feed tube communicates with a hopper, and disposed within the hopper is a rotating vane seal which allows material to enter the heating chamber in the drum without allowing gases to escape. A spray bar disposed within the infeed end of the rotating drum is supplied with asphalt from a tank which is heated by hot gases within the heating chamber.

The drum is loaded by means of the hopper, vane seal, and feed tube with virgin aggregate and/or recycled blacktop. Depending upon the requirements of the feed material, asphalt from the spray bar is added, wetting the aggregate. Flights within the rotating drum lift and mix the asphalt and aggregate, and lifting flights load the aggregate into partitions formed along the axis of the drum. The partitions are formed by quadrant plates which divide the central portion of the drum into four equal quadrants. The quadrant plates have drop slots which allow the material to pass from one quadrant to another. The lifting flights extend the length of the drum and lift and drop the material within the quadrants. The asphaltic material leaves the quadrants before the end of the drum. The asphaltic material enters a final mixing section of the drum where a rejuvenating spray bar may supply additional asphalt and/or rejuvenating agent to the mixture. Fixed unloading flights disposed within the exit of the drum unload the asphaltic material and drop it down a chute which is sealed from the atmosphere by a clamshell spring-loaded door. The unloading flights are attached to a support ring and are disposed around a circular aperture in the rear of the drum. Between the unloading flights is an open area where microwave or high volume sound may be beamed to the interior of the drum.

The exterior of the drum is covered by fins. The fins may be angled and cupped so as to mix the gases within the heating chamber, to encourage them toward the rear of the heating chamber and to bring volatiles from the top of the heating chamber to the burners disposed beneath.

Hot combustion gases from the burners are induced by the fins to flow to the end of the heating chamber and are deflected by a rear baffle into the unloading end of the drum. The gases flow in a direction opposite to the aggregate moving through the drum and exchange heat with the asphaltic aggregate. The exhaust gases remove moisture from the asphaltic aggregate and exit the material loading end of the drum into the preheat or condensing zone of the chamber where the moisture-laden exhaust gases condense on the drum surface and fins thus heating the drum and washing out entrained particulates. The condensation and entrained particulates are removed from the preheat section of the chamber by an auger positioned in a trough within the floor of the preheat chamber. Volatile gases which may rise to the top of the preheat chamber are vented to the burner nearest the preheat chamber where they are afterburned.

The exhaust gases leave the preheat chamber through exhaust ports and enter flat stack scrubber units disposed along the sides of the heating chamber. The flat stack scrubbers consist of narrow trapezoidal boxes disposed along the sides of the chamber. The flat stack scrubbers have a side adjacent to the heating chamber and a side opposite the heating chamber. They have a top, which is open to the atmosphere, a bottom and two end plates. The side adjacent to the heating chamber has a hole which communicates with the exhaust gas ports in the preheating end of the chamber. The flat stack scrubbers have a plenum defined by the bottom and lower portions of the adjacent side, opposite side, and ends of the flat stack. The plenum has an outlet spaced between the adjacent side and opposite side, the plenum outlet has holes for the uniform exhaustion of heating chamber gases into the flat stack.

The top of the flat stack is open to the atmosphere for the venting of heating chamber gases. Disposed within the opening at the top of the flat stack is a scrubber spray bar which is suspended between the ends of the flat stack and which sprays water down over the rising gases coming from the plenum. Water from the spray bar penetrates down into the plenum and flows out along the flat stack bottom to a sump where it is pumped to a scrub water tank.

The scrub water tank has a top and a bottom and side wall. The side wall has an asphalt clean-out port spaced from the top of the tank and a fines clean-out port spaced from the bottom of the tank. The tank has a wash water inlet connected to a pump which communicates with the sump, the inlet being spaced from the bottom and the top.

The tank has a water outlet which is spaced between the water inlet and the fines clean-out port. The tank has a float sensor spaced from the top of the tank above the asphalt clean-out port for sensing the level of fluids within the tank. Water flows from the scrub water tank through the outlet to a second pump, which supplies water to the spray bar. The outlet pump also supplies water to a drip bar disposed along the top of the scrubber stack side opposite the heating chamber. Flow of water to the evaporator drip bar is controlled by a solenoid, which in turn is controlled by a float sensor, which causes the opening of the solenoid valve to the drip bar when the float sensor detects excess water in the scrub water tank. Water from the drip bar drips down the exterior side of the flat stack and is evaporated. Water which is not evaporated is collected in a trough at the bottom of the opposite side of the flat stack and flows from the trough to the sump where it is recirculated.

The asphalt plant apparatus of this invention may be connected to a tractor at its forward end by a hitch and is provided with hydraulic jacks in front and back which serve the function of adjusting the angle of the heating drum as the plant is towed over the paving surface. When used in stationary configuration, a forward jack, which is controlled by a hydraulic cylinder, controls the tilt angle of the plant apparatus and the drum.

It is an object of the present invention to provide an asphalt plant which is thermally efficient.

It is a further object of the present invention to provide an asphalt plant which can rapidly heat large amounts of asphaltic aggregate without heating any of the asphalt above 375° F.

It is also an object of the present invention to provide an asphalt plant which can process asphaltic paving mixtures containing up to 100% of recycled asphalt paving.

It is yet another object of the present invention to provide an asphalt plant which is adaptable to computer control.

It is an additional object of the present invention to provide an asphalt plant utilizing conductive, radiative, convective counter flow and condensing steam to effect heat transfer.

It is a still further object of the present invention to provide an asphalt plant which incorporates integral pollution control.

It is another object of the present invention to provide an asphalt plant which provides extended-wear life for the mixing drum.

It is also another object of the present invention to provide an asphalt plant in which microwaves may be easily and safely employed.

It is yet an additional object of the present invention to provide an asphalt plant adapted for employing sound for cleaning the drum mixer.

It is a further object of the present invention to provide an apparatus which vibrates the air matrix surrounding suspended asphaltic material to effect more efficient heat transfer to the material.

It is a yet further object of the present invention to provide an asphalt plant where volatiles released from the asphalt are removed from combustion gases and reburnt.

It is also a further object of the present invention to provide an asphalt plant employing condensing water vapor to remove particulates from the combustion gas exhaust.

It is a still additional object of the present invention to provide an asphalt plant which may use a stoker-fed burner, burning pelletized waste or the like.

Further objects, features and advantages of the invention will be apparent from the following detailed description when taken in conjunction with the accompanying drawings.

DESCRIPTION OF THE PREFERRED EMBODIMENT

Figure 1A:
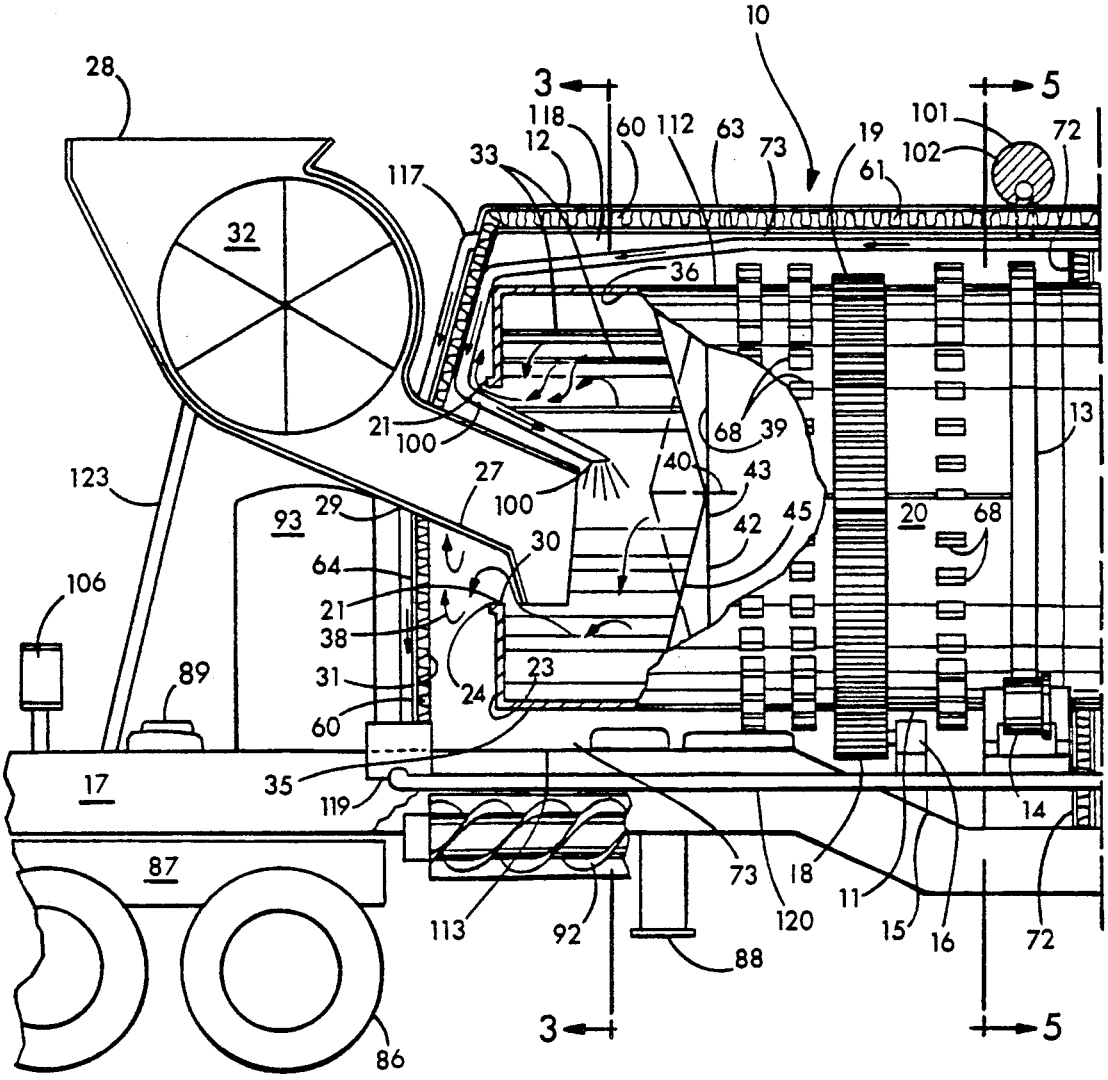
FIG. 1A is a side elevational view, in partial cross-section, of the forward section of the asphalt plant apparatus of this invention.
Figure 1B:
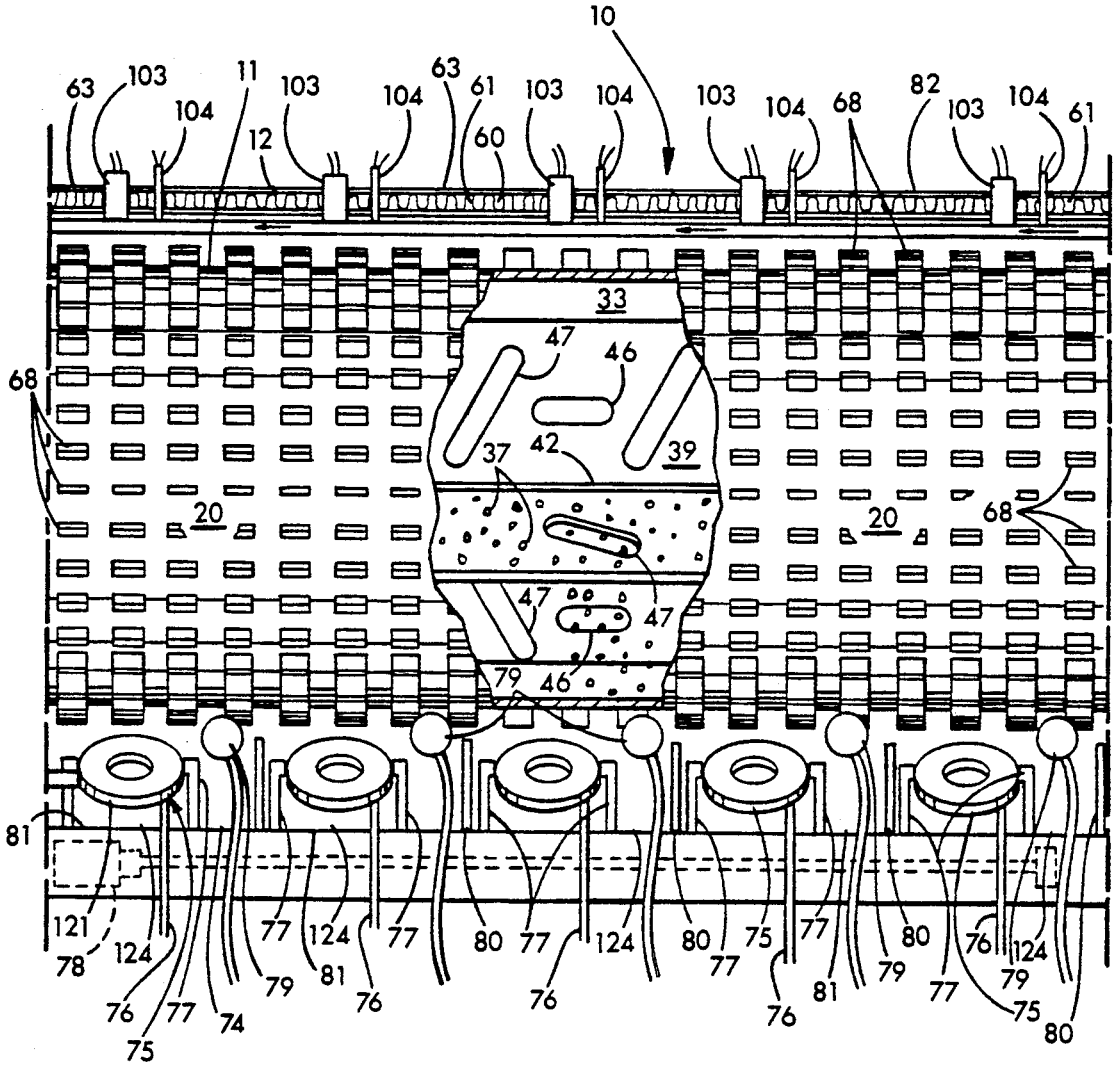
FIG. 1B is a side elevational view, partially cut away, of the middle section of the asphalt plant apparatus of this invention.
Figure 1C:
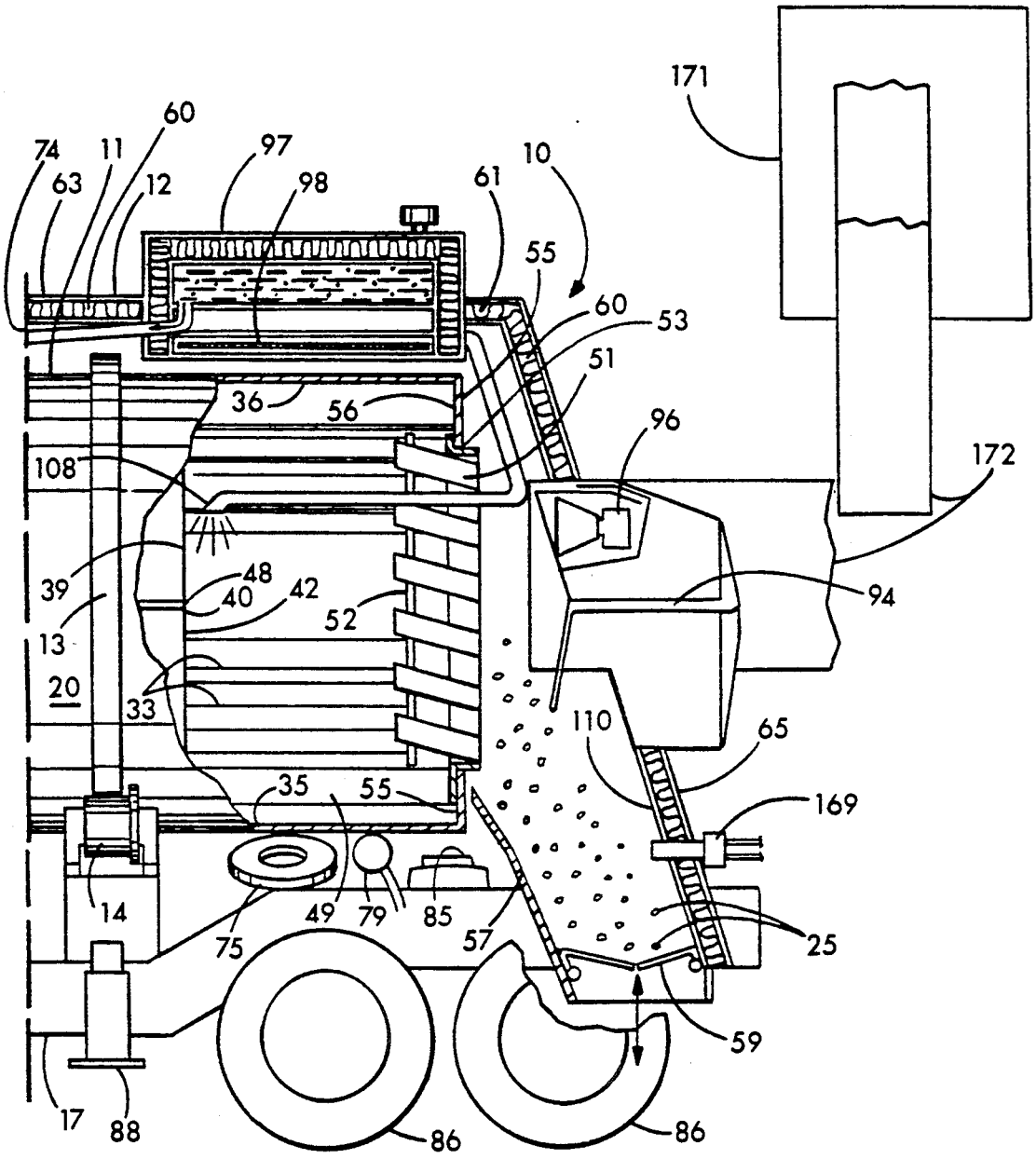
FIG. 1C is a side elevational view, partially cut away, of the rear portion of the asphalt plant apparatus of this invention.
Figure 7:
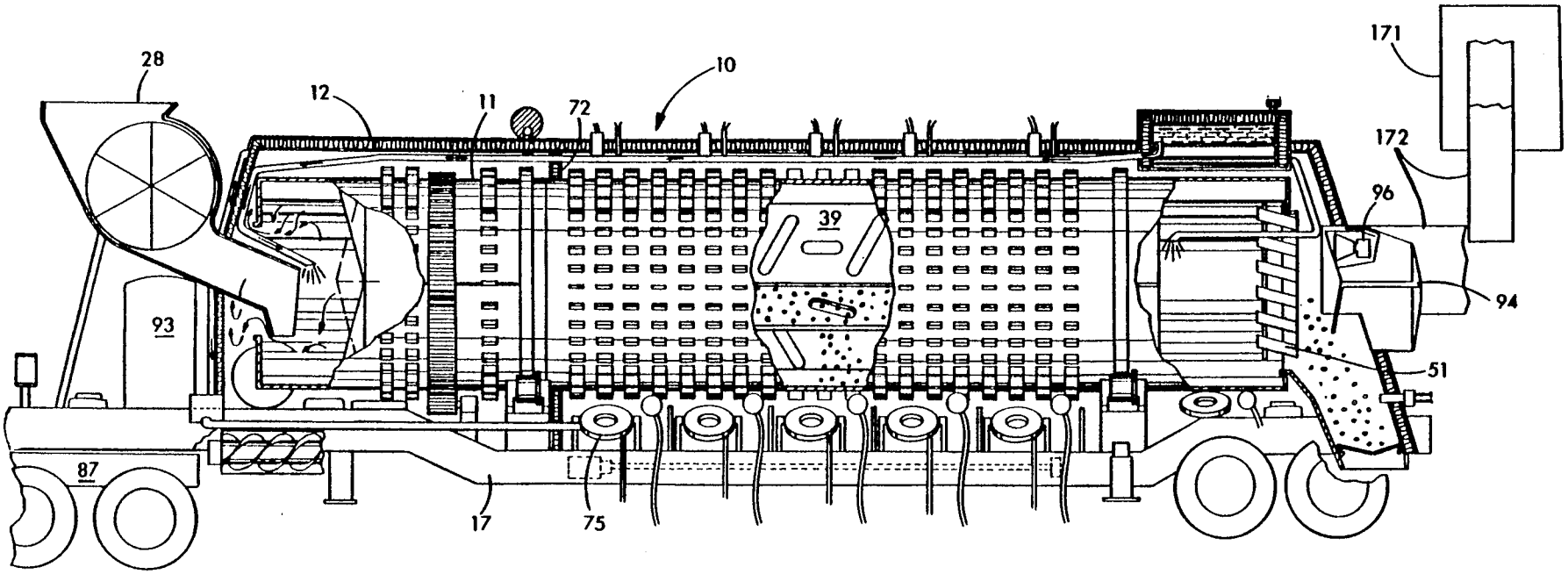
FIG. 7 is a side elevational view, partially cut away, of the asphalt plant apparatus of this invention, combining FIGS. 1A, 1B and 1C.

Referring more particularly to FIGS. 1A–7 wherein like numbers refer to similar parts, an asphalt plant apparatus is shown in FIGS. 1A, 1B and 1C, which may be joined together to show the plant 10 as seen in FIG. 7. As best seen in FIGS. 1A–1C, the asphalt plant apparatus 10 has a drum mixer 11 spaced within a heating chamber 12. The drum 11 has a circumferential band 13, shown in FIG. 1A, which rides on flange rollers 14 which are mounted on an elongated frame 17. The drum 11 is caused to rotate by a motor 15 which powers a transmission 16 which drives a transmission sprocket 18 which engages the drive sprocket 19. The drive sprocket 19 is circumferentially mounted on the exterior 20 of the drum 11.

Figure 2:
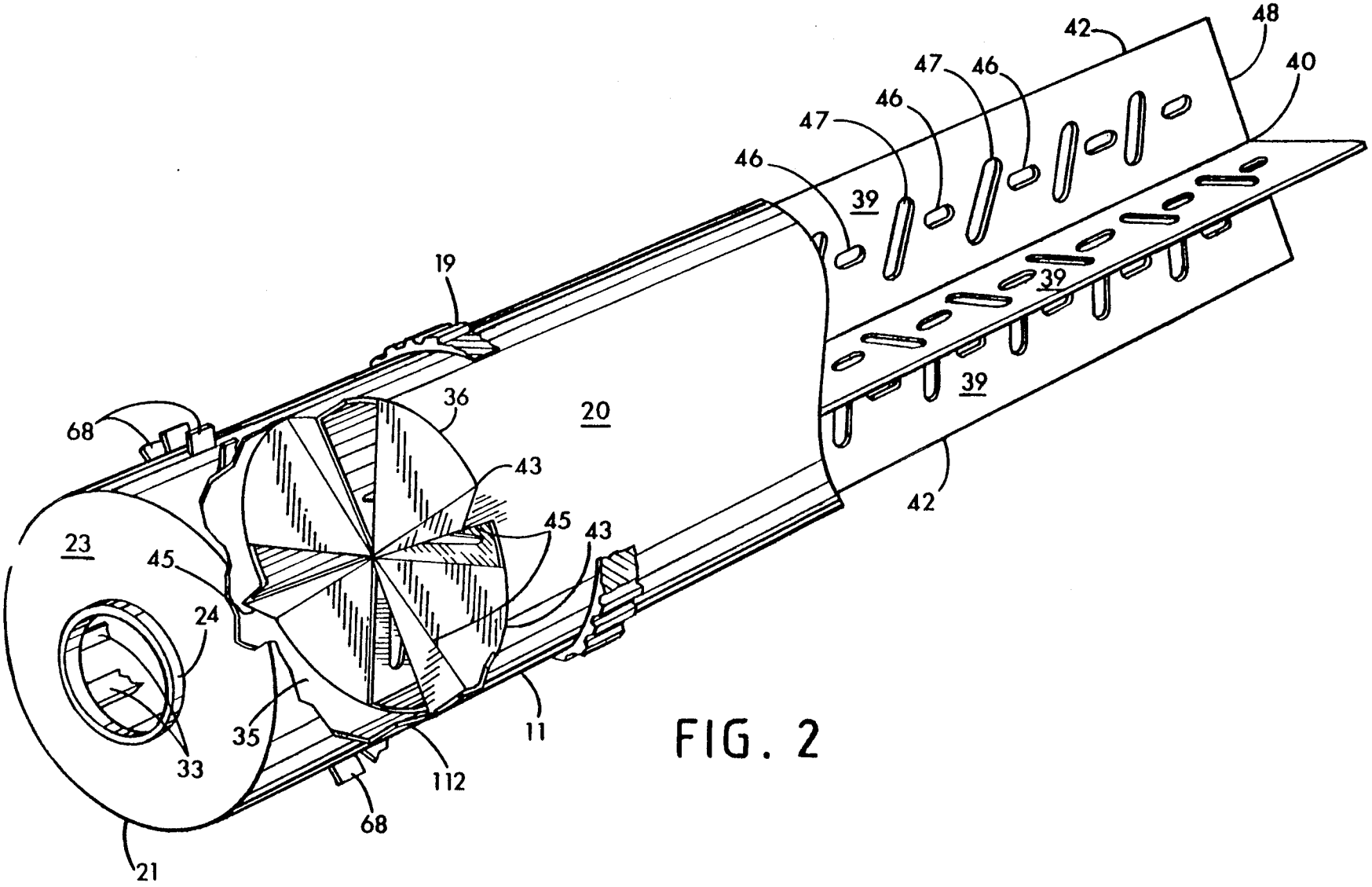
FIG. 2 is a perspective view, partially cut away, of the cylindrical drum of the apparatus of FIGS. 1A–1C.
Figure 3:
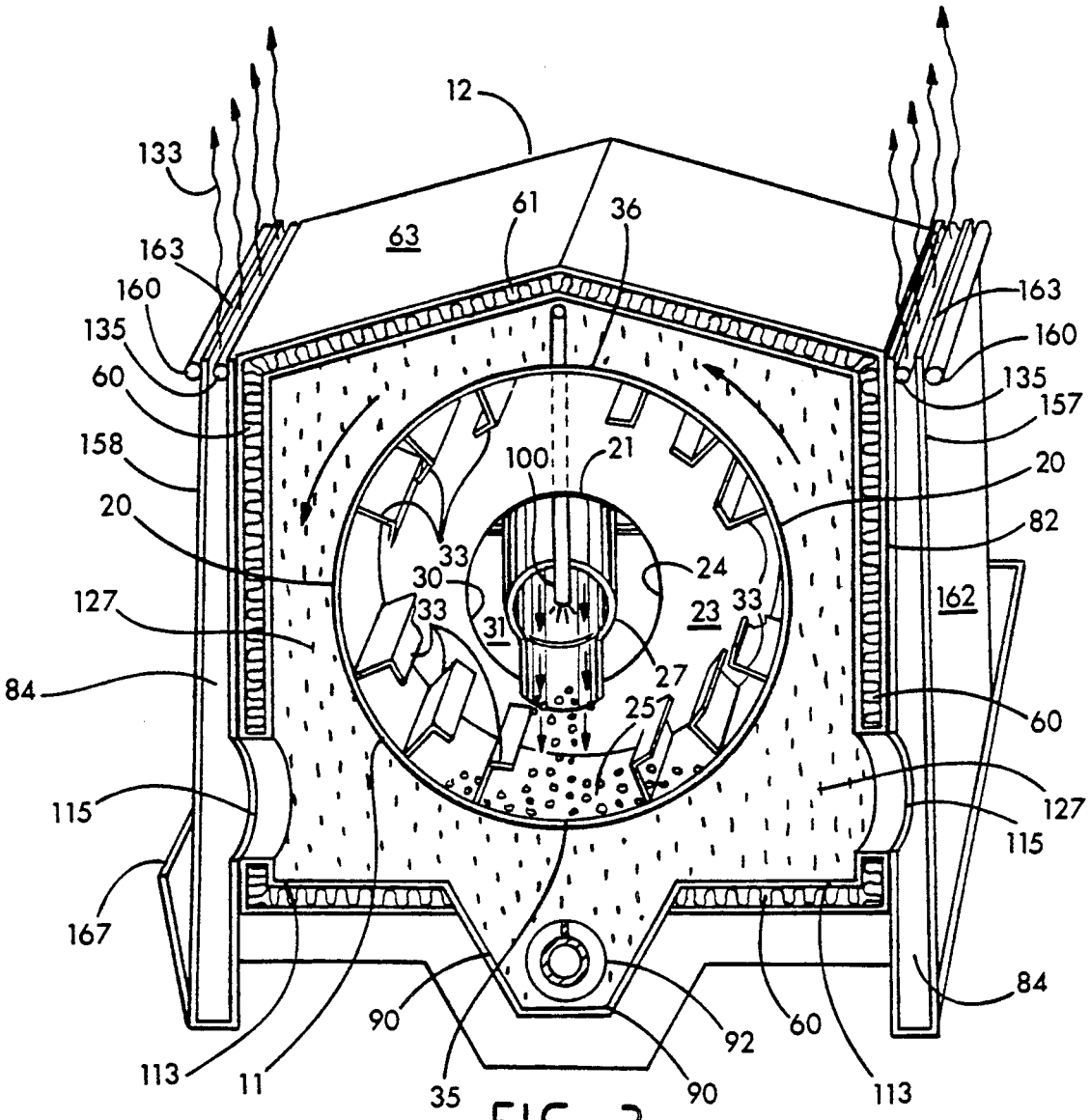
FIG. 3 is a perspective cross-sectional view of the asphalt plant apparatus of FIG. 1A taken along section line 3—3.

The drum 11 has a material infeed end 21, best seen in FIGS. 1A, 2 and 3. The infeed end 21 has a forward end plate 23 which has a circular opening 24 through which aggregate or recycled asphaltic material (RAP) 25 may enter the drum 11. The aggregate or RAP 25 is supplied to the drum infeed end 21 of the drum 11 by a feed tube 27 which communicates with a feed hopper 28 through an aperture 29 in the end wall 31 of the heating chamber 12.

A vane seal 32 is spaced between the feed hopper 28 and the feed tube 27 to prevent the escape of gases from the heating chamber 12 through the feed tube 27.

Virgin aggregate or RAP 25 is fed into the drum mixer 11 within the heating chamber 12 where it can be heated and mixed to form asphaltic pavement. Material will conventionally be supplied to the feed hopper 28 by a conveyor, screw auger or the like (not shown) with a steady stream of material 25 being supplied for processing by the asphaltic plant apparatus 10.

Combustion gases flow through the drum 11 and exit the drum 11 through an annulus 30 formed between the end plate 23 and the feed tube 27, the exhaust annulus 30 is the unblocked portion of the aperture 24.

Figures 5, 6:
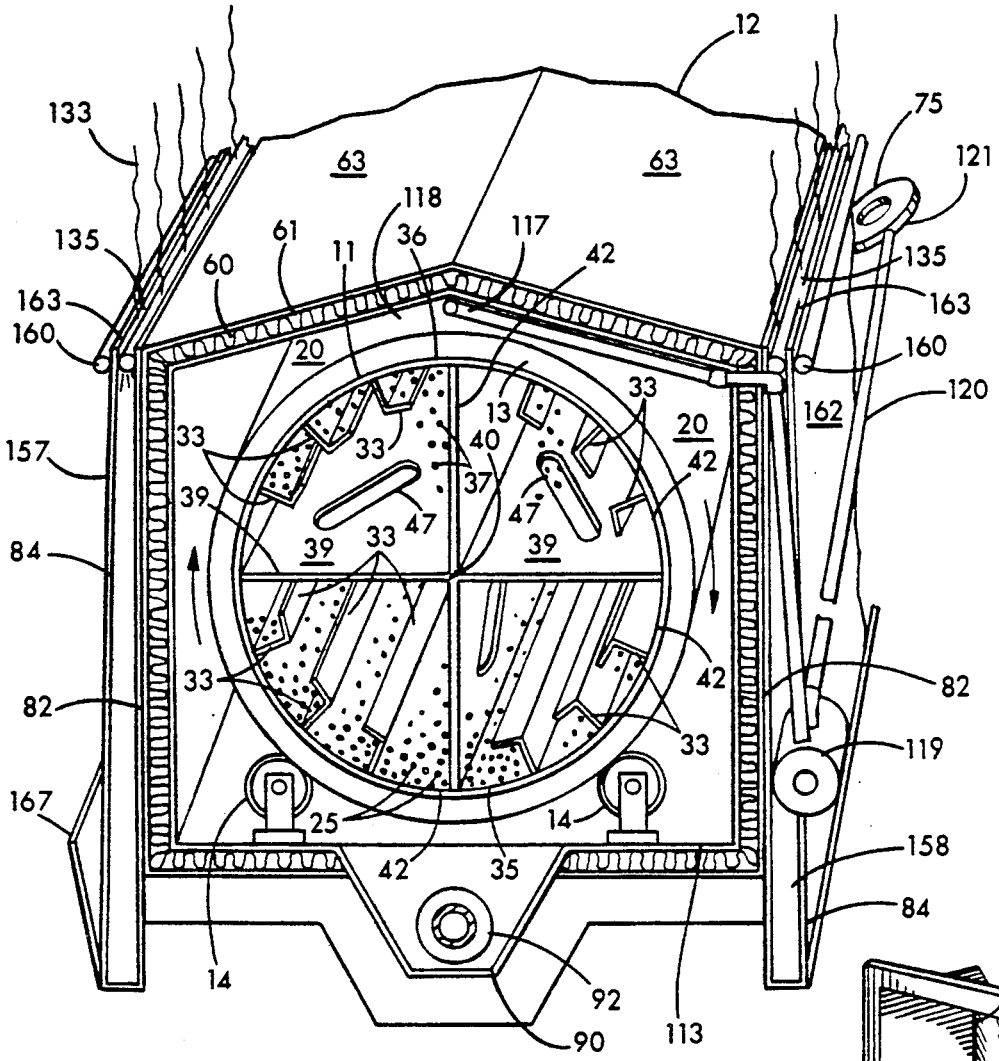
FIG. 5 is a perspective cross-sectional view of the asphalt plant apparatus of FIG. 1A taken along section line 5—5.
FIG. 6 is a front perspective view of a fin which may be mounted on the drum mixer of this invention.

Spaced within the drum 11 are lifting flights 33. The lifting flights 33, which have an L cross-section as seen in FIG. 3, serve to scoop up material 25 from the bottom 35 of the drum 11 and elevate the material 25 to the top 36 of the drum 11 where it may cascade down forming a veil of airborne material 37 as seen in FIG. 5. The process of creating a veil of asphaltic material 37, mixes the material 25 and exposes it to the combustion gases (as indicated by arrows 38 in FIG. 1A) passing through the drum 11.

The central portion of the drum 11 is bisected by quadrant plates 39 which intersect the axis 40 of the drum 11 and divide the drum 11 into four compartments 42 as seen in FIG. 2 and 5. The forward end 43 of the quadrant plates 39 as seen in FIG. 2 have attached thereto to quadrant fill flights 45. The quadrant fill flights 45 fill the quadrants 42 with asphaltic aggregate 25. The fill flights 45 fill the quadrant compartments 42 by scooping material 25 out of the bottom 35 of the drum and directing it on to the quadrant plates 39. The forward end 43 of the quadrants 42 have partial closures or cover plates 44 which help to prevent material 25 from falling out of the quadrants 42 after the material 25 has been loaded into the quadrants 42 by the fill flights 45.

The quadrant plates 39 have drop slots 46 and 47 which penetrate the quadrant plates 39 and allow the movement of asphaltic material 25 from one quadrant 42 to another. These drop slots 47 are preferably offset to improve the mixing and heating of material 25. At the rearward end 48 of the quadrant plates 39 the asphaltic material 25 passes into a final mixing segment 49 of drum 11, as best shown in FIG. 1C. The asphaltic material 25 is unloaded from the final mixing segment 49 by a series of unloading flights 51. The unloading flights 51 are attached to a support ring 52 which holds the unloading flights 51 in a aperture 53 in the end plate 55 which covers the rear end 56 of the drum.

The unloading flights 51 discharge the asphaltic material 25 to a discharge drop chute 57 which is closed by a spring-loaded, clamshell-type sealing door 59.

The heating chamber 12 which surrounds the drum 11 contains thermal insulation 60 for retaining heat within the chamber 12. The insulation 60 is located in the interior 61 of the top 63 and forward 64 and rear 65 ends of the heating chamber as shown in FIGS. 1A, 1B and 1C. Though not shown in FIGS. 1A through 1C, all sides of the heating chamber 12 are insulated as illustrated in FIGS. 3 and 5.

The exterior 20 of the drum 11 has a multiplicity of fins 68 which are preferably cupped-shaped as seen in FIG. 6, although or clarity they are shown as simple rectangles in FIGS. 1A, 1B, 1C and 7, for stirring the gases within the chamber 12. The fins 68 are preferably angled as shown in FIG. 6 so as to stir the gases and move them towards the rear 65 of the heating chamber 12. When the fins 68 are angled, they act like turbine blades and push the combustion gases toward the rear 65 of the heating chamber 12.

The heating chamber 12 is divided by a baffle 72 shown in FIG. 1A. The baffle 72 separates approximately the forward one-third 73 of the heating chamber 12 from the remaining two-thirds 74 of the heating chamber 12. Within the rearward two-thirds of the chamber 74 are a multiplicity of burners 75, see FIGS. 1B and 1C, spaced along the axis of the drum 40. The burners 75 are rotatively mounted on fixtures 77 with the axes of rotation of the burners parallel to the axis of the drum 40. The burners 75 can be rotated by an angle-of-address control mechanism 78 shown in FIG. 1B by means of a mechanical linkage to the burners 75, not shown, which rotates the burners 75. The rotation of the burners 75 moves the burner flame from impinging perpendicular to the drum surface 20 to an angle almost tangent to the surface of the drum 20.

The burners 75 are supplied with fuel by fuel lines 76. The burners 75 may be pulsed on and off by a valve, not shown, controlling the fuel supply 76 to each burner 75. A sensor 79 is located in the proximity of each burner 75 to sense when the burner 75 is in the "on" condition. The burners 75 are separated by baffles 80 which serve to contain the heat from a single burner 75 to an individual heating zone 124. The bottom 81 near the burners 75 is preferably reflective to improve heat transfer to the drum 11. Power lines (not shown) drive the burner blower (not shown) to supply air for combustion with the burners' fuel.

On the sides of the heating chamber 82, as seen in FIG. 3, are flat stack scrubber units 84 which are described in more detail below.

The heating chamber 12 with the drum mixer 11 located therein is mounted on a transport frame 17 which has wheels 86 so it may be pulled behind a tractor (not shown).

When the plant 10 is pulled by a tractor it is attached by an elevating hitch 87, shown in FIG. 1A, which, together with rear elevating jack 85, shown in FIG. 1C, controls the angle of slope of the transport frame 17 which tilts the axis 40 of the drum 11. The drum 11 is normally tilted from the material infeed end 21 to the material outfeed end 56 to encourage material to move through the drum. The tilt for a 50 foot drum would be approximately 6 inches from the horizontal from the infeed end 21 to the outfeed 56. The drum is also tilted to compensate for the slope of the paving surface over which the plant apparatus 10 is moved.

The asphalt plant 10 can also be used as a stationary plant, in which case jacks 88, shown in FIG. 1A and 1C, in combination with a hydraulic cylinder 89 at the mixer front, controls the elevation of the plant 10.

Mounted in the frame 17 in the forward one-third 73 of the chamber 12 and spaced within a depression 90 is a screw auger 92 for removing water and fines from the forward section 31 of the heating chamber 12.

Also mounted on the transport frame 17 is a scrubber water tank 93, shown in FIG. 3, which forms part of the exhaust scrubber system 84, which is described further below.

Mounted on the rear end 65 of the heating chamber 12 is a microwave waveguide 172 for irradiating the asphaltic aggregate through the rear of the drum 53. Also mounted on the heating chamber rear 65 is a sound source 96 for irradiating the rear of the drum 53 with sound energy to effect cleaning of the drum and to improve heat transfer within the drum 11. Also mounted on the rear end is an ultrasound irradiating antenna 94 to irradiate the drum interior to improve heat transfer within the drum 11.

Mounted on the top 63 of the chamber 12 over the rear 65 is an asphalt tank 97, see FIG. 1C, which penetrates the top 63 of the heating chamber 12 and is separated from the interior of the heating chamber 12 by a baffle 98 which controls the amount of heat from the chamber 12 which exposes the asphalt tank 97. The asphalt tank 97 has a supplemental heater (not shown) for heating the asphalt during start up of the asphalt plant 10. The asphalt tank 97 communicates with an asphalt spray bar 100 spaced within the infeed end of the drum 11. The asphalt tank 97 may be used as a tank for spraying rejuvenating liquids, in which case it supplies material through the rejuvenating spray bar 108 spaced within the drum end 56.

Also mounted on the top of the heating chamber 63 is a halon gas container 102, seen in FIG. 1A, which communicates with the interior forward section 73 of the heating chamber. The halon gas 101 can be released to the interior of the chamber 73 by means of an automatic or manually operated valve, not shown, for the purpose of extinguishing a fire within the asphalt plant 10. Trapped volatiles within the forward section 73 are the most likely source of fires and so the halon gas container 102 is positioned over that section of the chamber 12.

Spaced along the top 63 of the heating chamber 12 and penetrating into the heating chamber 12 are a multiplicity of radiative heat detectors 103 and thermocouples 104 which are spaced along the axis of the drum, see FIG. 1B. The radiative sensors 103 serve to sense the temperature of the drum exterior 20 passing beneath the sensor 103. The thermocouples 104 serve to sense the temperature of the combustion gases inside the heating chamber 12.

To better illustrate how the asphaltic plant apparatus 10 functions to achieve the advantages of this invention, the heat exchange process and the flow of material and gases through the apparatus 10 is here explained.

The asphaltic plant apparatus 10 seen in FIG. 7 achieves the rapid heating of a large quantity of virgin aggregate and/or recycled blacktop without subjecting the same to high temperatures by the innovative use of conduction, radiation and counterflow heat exchange to transfer heat from the burners 75 to the asphaltic material 25.

As important as the method of heat transfer is, the controllability is also important in preventing overheating of any portion of the drum 11. The heat is generated in zonal burners 75 which are separated by baffles 80 which define individual heating zones 124. The burners or heat sources 75 may be pulsed on and off in response to the temperature sensed by the radiant heat sensor 103 which measures the temperature of the drum exterior 67. The burners 75 are supplied with combustion air by blowers (not shown) which may be mounted on the underside of the support frame 17. The flame from the burners 75 impinges on and heats the drum surface 20 and the fins 68 by radiative and convective heat transfer. The hot combustion gases are somewhat confined to a particular zone by the baffles 80.

The hot gases rise to the top of the heating chamber 12 and heat the drum 11 around its entire circumference. The fins 68 mounted on the exterior of the drum 20 serve a number of purposes in the heat transfer process: absorbing heat indirectly from the combustion gases and directly from the burner 75 flame as the fins rotate through the burner 75 flame. The fins conduct heat to the drum surface where it is further conducted to the interior of the drum and into the lifting flights 33 and the quadrant plates 39, which then by conduction and radiation transfers heat to the asphaltic aggregate materials 25 moving through the drum 11.

Through the use of feedback from the drum temperature sensor 103 and the heating chamber zone sensor 104, the burners 75 may be pulsed on and off and their aspect angle adjusted to achieve a uniform temperature about the circumference of the drum 11 and within each heating zone 74. This control of each zone means that the heat transfer along the drum 11 can be optimized for each type of asphaltic material being processed by the drum 11 without danger of overheating the material 25.

The fins 68, which are shown in FIGS. 1A–1C and 7, serve not only to conduct heat into the drum 11 and stir the gases within a heating zone 12, but because they are preferably tilted with respect to the axis 40 of the drum 11, they urge gases towards the rear of the heating chamber 65.

The fins preferably have cups or cavities 71 as shown in FIG. 6 and serve to scoop volatiles, unburnt hydrocarbons, and heated gases from the top of the heating chamber 12 and bring them down where they may be completely burned by the burners 75. The fins also serve to transfer heat from the heated air to the cool zone. The fins 68 will preferably be mounted along a line 69 which is parallel to the drum axis and are tilted by being bent along a line 70.

The heating chamber 12 may be adapted to burn some portion of pelletized waste with the resultant benefits of lowered fuel costs and waste disposal effectiveness. In the case where wastes are burnt, the use of cupped fins is particularly important to afterburn the combustion products of the waste.

As the asphaltic material 25 passes through the drum 11, its temperature increases from the infeed end 21 to the outfeed end 56. The hot combustion gases produced by the burner 75 and moved by air pressure and the fins 68 move to the rear of the drum where they are deflected by a rear baffle 110 on the inside of the rear of the heating chamber 65 and enter the rear of the drum 11 through an aperture 53, between the unloading flights 51 shown in FIG. 1C.

The rear heating zone 74 of the heating chamber 12 is separated from the forward preheat section 73 by the baffle 72, as shown in FIG. 1A, which prevents the flow of gases between sections of the heating chamber 12. The rear heating section 74 is closed from the atmosphere at the asphalt aggregate exit by the spring-loaded sealing door 59, FIG. 1C, such that the combustion air supplied by the blowers and the combustion gases generated by the heater 75 have no exit from the heating chamber 12 except through the rear discharge end of the drum 11. Due to the convective draft and the tilted fins 68 acting as turbine blades, the pressure will be lower in the heating section 74 than in the preheating section 73, so the baffles 72 need not be tightly sealed. Any leaking will be into the heating zone 74 with no loss of heat.

A heat exchanger for heat transfer between a solid and a gas can be of two types: parallel flow or counterflow. In a parallel flow system, the material to be heated and the hot gases enter the drum or heat exchanger from the same end and flow along parallel to each other. Heat is transfered from the hot gas stream to the cool material stream. The efficiency of this method is limited because the gas always remains warmer than the material which it is heating. The output of such a parallel flow heat exchanger is warmed material and somewhat warmer gas. Much of the heat in the system remains in the warm gas.

In a counterflow heat exchanger, cold aggregate or material 25 enters the infeed end 21 of the drum 11 and hot gases enter the other end 56 of the drum 11 which is functioning as a heat exchanger. The material 25 flowing through the drum 11 first meets and exchanges heat with gases that have already passed through the drum 11 and given up most of their heat. But because the incoming material 25 has not yet been heated at all, it is able to absorb some heat from the relatively cool gases. As the material moves down the drum or heat exchanger, the temperature of the gases increases as the material approaches the exit of the drum 53, so as the material gets hotter, the gases heating it also get hotter. Finally, at the exit of the drum 53, the material, which has almost reached its maximum temperature, meets the hottest gases, which have not yet been cooled by contact with any material. Because the hottest material is being heated by the hottest gases and the cool gases are being further cooled by the unheated material, the material 25 leaving a heat exchanger drum 11 can be considerably warmer than the gases leaving the chamber. In a counterflow heat exchanger, nearly all the heat in the gases is transferred to the material and very little leaves in the gases. Furthermore, air is scrubbed of airborne hydrocarbons which are products of the heating fuel combustion.

The asphaltic plant apparatus 10 of this invention utilizes the counterflow of the heated combustion gases with the asphaltic material moving through the drum mixer 11 to achieve highly efficient heating of the asphaltic material.

The description of the heat transfer process given above is further complicated by the presence of moisture or water in the virgin aggregate or recycled blacktop material. As the virgin aggregate or RAP 25 moves through the drum 11, the water therein is evaporated and is removed from the drum 11 as water vapor. The evaporating of a pound of water takes approximately as much heat as it takes to warm eight pounds of asphaltic material to an output temperature of 300° F. As the input material 25 may on occasion have a water content as high as one-eighth of the material feed, the importance of recovering some portion of the heat used in drying the material is evident.

The asphaltic plant apparatus 10 utilizes a partitioned heating chamber which has a forward preheat zone 73, shown in FIG. 1A, which is separated by a baffle 72 from the heating zone 74 which contains the burners 75. This forward or preheat zone 73 allows the condensing of the water vapor contained in the exhaust gases on the forward section 112 of the drum 11. By condensing the water vapor on the outside of the drum 11 heat is transferred to the aggregate 25 without wetting it. The preheat zone 73 also serves to remove particulates from the exhaust gases as the condensing water vapor often forms droplets 127, seen in FIG. 3, around dust particles, which are then carried by gravity to the bottom 113 of the preheat zone 73 where a screw auger 92 disposed in a depression 90 removes the water and dust or fines from the preheat zone 73 of the heating chamber 12. The cool exhaust gases then vent through exhaust ports 115, which have an area approximately the same as the drum exhaust annulus 30. The exit gases flow through ports 115 which are placed low in the enclosure to exit only the coolest exhaust gases into the flat stacked scrubbers 84 located along the sides 82 of the heating chamber 12.

To reduce the amount of volatiles going to the flat stack scrubbers 84 and venting to the atmosphere a pickup 117 tube positioned at the top 118 of the preheat section 73, and shown in FIG. 1A, communicates with a blower 119 shown in FIGS. 1A and 5, which removes volatiles which gather at the top 118 of the preheat zone 73. The blower 119, which should, if located in line with exhaust gases, be rated for use in explosive atmospheres, conducts the light hydrocarbon vapors from the top 118 of the condensing zone 73 to the first burner 121 by means of a tube 120. Within the heating chamber 12, the hydrocarbon vapors are burnt.

When the plant is operated, the material flows through the asphaltic plant apparatus 10 and asphaltic paving material is produced, by a process which begins with the feed hopper 28, seen in FIG. 1A, which receives material 25 from a conveyer or screw auger, not shown, which provides a steady stream of virgin asphalt, recycled blacktop, or mixture of the two, to the hopper 28. The hopper 28, which is supported by a bracket 123, has a vane seal 32 which functions as a revolving door which allows material to pass down the feed tube 27 without allowing combustion gases to escape. The feed tube 27, best seen in FIG. 3, dumps the material into the infeed end 21 of the drum 11 where the material is mixed by the lifting flights 33 and heated by the exiting combustion gases. If the material contains virgin aggregate, asphalt is added from the asphalt tank 97, shown in FIG. 1C, by means of a spray bar 100 which is spaced within the drum end 21. The asphalt in prior art asphaltic plants is added after the aggregate is heated to avoid scorching, but because of the controlled, low temperature, heating of the asphaltic plant 10 of this invention, the asphalt may be added before the aggregate is heated. This has the benefit that the asphalt is available to trap the fines normally associated with the aggregate 25 and so reduce the amount of dust which becomes airborne in the escaping combustion gases, shown by arrows 38, in FIG. 1A.

The forward section 112 of the drum 11 between the end plate 23 and the forward end 43 of the quadrant plates 39 forms a premixing zone where aggregate 25 is mixed with asphalt from a spraybar 100. The forward section 112 of the drum 11 is without quadrant plates 39 to allow clearance for the feed tube 27 and the spraybar 100. The incoming RAP or aggregate 25 is deposited by a feed tube 27 on the bottom 35 of a forward section 112 of the drum 11. From the bottom of the drum, the material 25 is lifted by lifting flights 33, which mix the material 25 and encourage the material toward the quadrant fill flights, shown in FIGS. 1A and 2. As the drum 11 rotates, the quadrant fill flights 45 scoop material 25 off the bottom 35 of the drum 11 into the quadrant compartments 42. Quadrant plate covers 44 prevent material loaded onto the quadrant plates 39 from falling back into the forward section 112 of the drum 11.

The addition of asphalt to the aggregate also serves to lubricate the aggregate which reduces drum wear and also results in less fines production in drum in the mixing and heating process. If the material being processed is 100% recycled blacktop, the RAP may be treated with a rejuvenating agent which is best mixed with the recycled blacktop when it is hot. Therefore, in the case of 100% recycled blacktop, asphalt would be added at the infeed end 21 in amounts to meet mix design.

As the aggregate 25 is mixed in the drum infeed end 21 and loaded into the drum quandrants 39 by the fill flights 45, the material is preheated by hot air and by heat from the condensing water on the outside of the forward section of the drum 112 in the condensing zone 73 which heats the forward sector 112 of the drum 11, best seen in FIG. 1A. The heat is then transferred by the interior surface of the drum 11 which together with the lifting flights 33 and the quadrant plates 39 transfers heat to the aggregate 25.

The lifting flights 33, best shown in FIGS. 3 and 5, transport the asphalt aggregate material 25 to the top of the drum where it cascades down under the force of gravity forming a veil of airborne material 37. In this way, the asphaltic aggregate exposes a large surface area over which counter-flowing combustion gases will exchange heat with the aggregate as the combustion gases move through the drum 11.

The quadrant plates of this invention, best shown in FIG. 2, have the advantage of allowing more material to be heated by contact with the combustion gases while flowing through the drum. The quadrant compartments 42 function as four drums within one and prevent excessive material from gathering in the bottom 35 of the drum 11. The quadrant plates 39 stiffen the drum 11. They support material off the bottom of the drum, as shown in FIG. 3, and balance the drum load. The quadrant plates 39 reduce the energy required to rotate the drum because the center of gravity of the loaded drum is moved closer to the axis of rotation; therefore, less energy is required to rotate the drum. The quadrant plates 39 have offset angled drop slots 47 and axial drop slots 46, shown in FIG. 2, which allow the asphaltic material to pass from one quadrant to the other assuring even mixing and a balance of the material between quadrants. The offset of the drop slots prevents the material from too rapidly moving from one quadrant to another.

At the end of the quadrant plates 48, the material moves into the final mixing section 49 of the drum 11, best shown in FIG. 1C. Within the final mixing section 49 is a spray bar 108 for rejuvenating fluid. The spray bar 108 communicates with the tank 97. Rejuvenating fluid or asphalt is added to heated recycled blacktop to replace volatiles which may have been lost through the aging of the blacktop pavement being recycled.

The material in the final mixing section 49 of the drum 11 may be irradiated with microwave energy from microwave wave guides 172, as seen in FIG. 1C. Asphalt is largely transparent to microwaves, and most of the microwave energy is absorbed in the aggregate where residual volatiles may be vaporized and be driven out of the pores of the aggregate. This allows the asphalt to sieve back into the aggregate forming a stronger bond between the aggregate and the asphalt. The microwave energy, if used, must be supplied from a source 171 which will require a separate vehicle and can be ducted to the drum interior by a wave guide 172 or by several wave guides mounted on the rear end of the heating chamber 12.

High energy sound supplied by a soundsource 96 and ultrasound generating antenna 94 subjects the asphaltic aggregate to sound waves, which are varying pressure waves in the combustion gases. These pressure waves can improve the heat transfer from the combustion gases to the aggregate. The sound energy can also stimulate portions of the drum to vibrate or oscillate so freeing any accumulation of asphalt and fines which may have adhered to the drum and thus cleaning the drum.

The asphaltic aggregate which has been, improved, mixed, heated, rejuvenated and possibly microwave irradiated is unloaded from the rear of the drum 56 by a plurality of unloading flights 51, which are attached to a support ring 52 and are disposed within the end 56 of the drum, as seen in FIG. 1C. The unloading flights are rigidly mounted to the drum and rotate with the drum, causing the unloading flights 51 to transfer asphaltic aggregate. The lifting flights 33 also lift the asphaltic material and drop it onto the unloading flights. The material on the flights 51 slides out of the drum 11 into the drop chute 57 past the spring loaded seal door 59. The seal door 59 prevents the escape of gases, but allows the asphaltic aggregate material 25 to fall to the roadbed where it may be picked up and used by a paver. The material 25 may alternatively be deposited on a conveyer, not shown, and transported by the conveyor to a paving machine. When the asphalt plant apparatus 10 is used in the stationary mode, the material 25 is transported by a conveyor or auger to a hopper for storage until it can be transferred to the road paving site.

The asphalt plant apparatus 10 utilizes a controlled flow of air and combustion gases through the plant apparatus 10 to achieve the dual benefits of high thermal efficiency and low emissions of atmospheric pollutants.

The flow of air, as described below, is controlled or restricted by louvres or seals 32, 59 so as to prevent the combustion gases from exiting the asphalt plant apparatus 10 except by flow through the drum 11. The combustion or exhaust gases are constrained to flow through the drum, with the drum forming an exhaust passage for the gases. This passage forces the gases to flow from the material outlet end 56 to the material infeed end 21, which results in the combustion gases counterflowing the asphaltic aggregate 25.

Air enters the heating chambers 12 through air inlets, not shown, mounted on the bottom of the truck frame 17. The air is admitted through a louver or damper over the air inlets, not shown, which allows the air to flow in only one direction into the heating chamber 12. The air then passes to a blower which supplies the air to the combustors or heaters 75 where the air is mixed with the fuel and burned. Any readily combustible fuel may be used such as No. 2 heating oil, propane, coal dust or natural gas. Choice of fuels will depend upon fuel costs and whether the plant apparatus 10 is used in the stationary or mobile configuration, fuel oil being the preferred fuel for mobile applications and natural gas being cost effective in many stationary applications.

The air and combustion products will enter the baffle zones 124, shown in FIG. 1B, which are defined by baffles 80 which are spaced along the axis 40 of the drum 11 in the heating zone 74 of the chamber 12. The fins 68 mounted on the exterior 20 of the drum 11 disposed above each heating zone 124 circulate the combustion gases to provide even heating around the circumference of the drum 11. Because the burners 75 may be pulsed to control the heat in each zone 124, the volume and temperature of the combustion gases along the axis 40 of the drum 11 in the direction of the drum end 56 are subject to control. The heating zones 124 and the zonal heaters 75 allow control of the temperature and velocity profile of the combustion gases as they move toward the drum end 56. Control of the temperature and velocity profile of the gases within the heating chamber 12 allows the optimization of the heat transfer while preventing overheating of the asphaltic material 25. The fins 68 may be angled as by bend line 70, shown in FIG. 6, to urge the gases towards the rear of the drum 56. They may also form scoops 71, as seen in FIG. 6, to capture gases from the top of the chamber 12 and deliver them to the burners 75 where they may be afterburned. When the combustion gases reach the end of the chamber 12, shown in FIG. 1C, they are deflected by the rear baffle 110 and enter the aperture 53 at the rear of the drum 56 through the support ring 52 between the unloading flights 51.

The combustion gases flowing in the direction opposite that of the asphaltic aggregate bring the asphaltic aggregate 25 in the final mixing zone 49 to the paving temperature, approximately 250° to 350° F. The combustion gases then enter the rear end 48 of the quadrant plates 39 in counterflow to the asphaltic material 25 which is raining down from lifting flights 33 and through the drop slots 46, 47. As the aggregate or recycled blacktop cascades in a veil through the exhaust gases, the large surface area of the aggregate is exposed to the combustion gases effecting rapid heat transfer. This heat transfer may be further improved by the use of soundwaves from a sound source 96, and ultrasound generation 94 best seen in FIG. 1C, which sends compression waves through the combustion gases which compresses the combustion gas molecules against the aggregate 25 wherein the kinetic energy, which is the thermal energy of the combustion gas molecules, may be more readily transferred by collision to the aggregate 25.

As the combustion gases proceed down the axis 40 of the drum 11, they will begin to counterflow with asphaltic aggregate 25 containing residual moisture. The combustion gases in the process of evaporating water contained in the asphaltic aggregate feed material 25 will decrease the energy represented by the temperature of the combustion gases and increase the energy of the combustion gases in the form of latent energy in the water vapor carried along in the gas stream. The combustion gas stream may also pick up undesirable fines consisting of small particles of aggregate and asphalt which may become airborne. The exhaust gases containing water vapor and undesirable fines pass out of the drum infeed end 21 through the drum gas outlet 30 as indicated by arrows 38, and enter the preheat zone 73, shown in FIGS. 1A and 3. The exhaust gases laden with water vapor effect a rapid and efficient heat transfer with the outer surface 20 of the forward section 112 of the drum 11 and the fins 68 which are disposed along the drum within the preheat zone 73.

The condensing water vapor within the condensing zone 73 causes a cleaning rain of water droplets 127 which tend to form about nucleating grains of dust the surface of which serves to initiate condensation. The rain 127 causes water and dust to fall to the bottom 113 of the condensing zone where a screw auger 92 disposed within a depression 90 removes the water and accumulated fines from the condensing chamber 73.

The gases exit from the condensing chamber 73 through exit ports 115 which penetrate the sides of the chamber 12 and communicate with the flat stack scrubbers 84, shown in FIG. 3.

Figure 4:
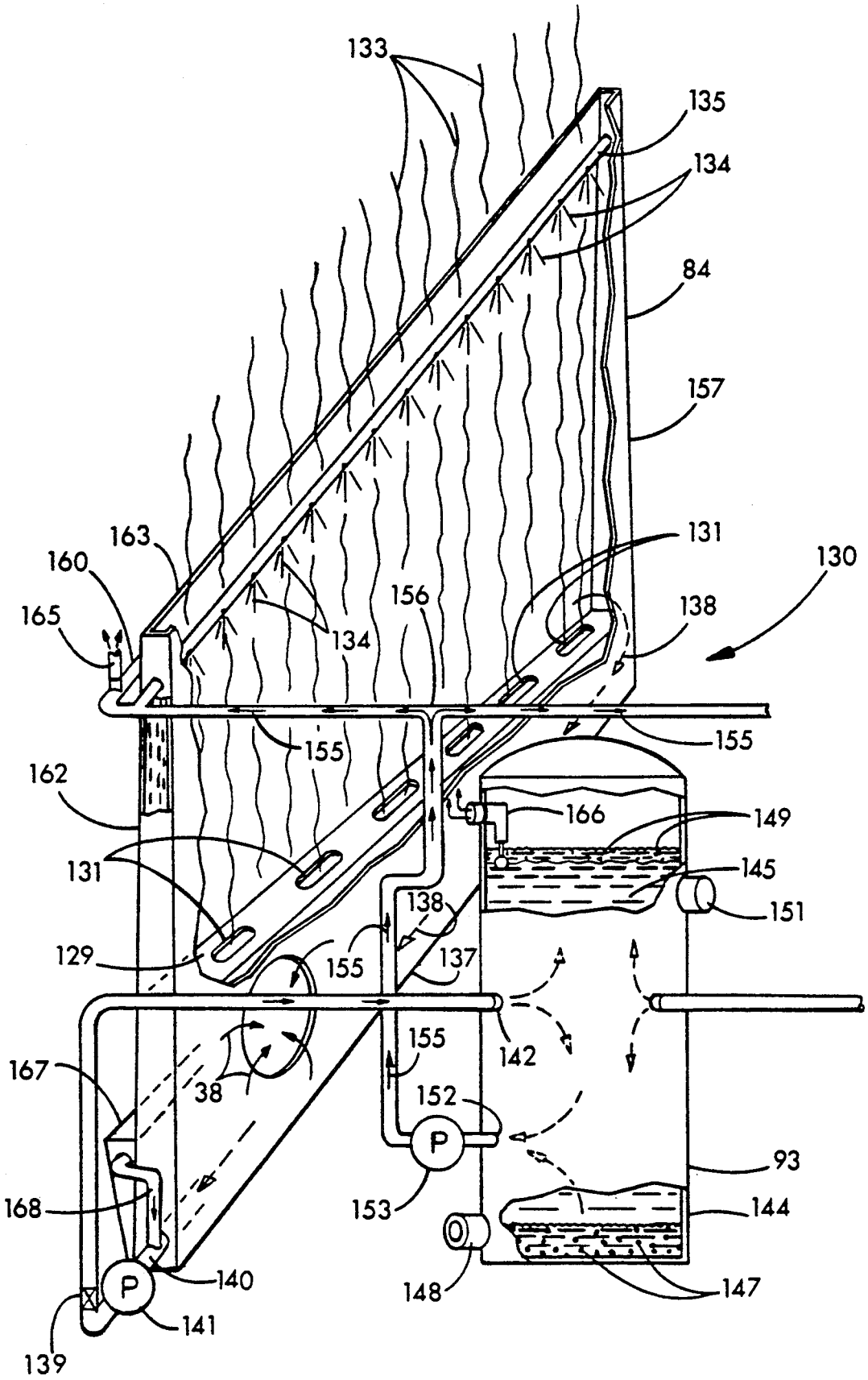
FIG. 4 is a partially schematic isometric view, partially cut away, of the flat stack scrubber system of this invention.

From the exit port 115 the gas flows, as shown in FIG. 4, into the plenum 129 disposed at the bottom of the flat stack scrubber 84. An exhaust gas scrubbing system 130 is shown in FIGS. 4 and 5. Exhaust gases enter the plenum 129 which distributes the exhaust gases through exhaust ports 131. The plenum 129 and the exhaust ports 131 are sized so that an even distribution of exhaust gases flows up through the flat stack 84 and out scrubber exhaust 63. The exhaust gases 133 are cleaned by a spray 134 of wash water 145 from the scrubber spray bar 135 which is positioned along the scrubber exhaust 163 at the top of the flat stack 84.

The wash water spray 134 counterflows with the exhaust gases 133, as seen in FIG. 4, and entrains exhaust gas particulates. The wash water, shown by arrows, 138 drains along the bottom 137 of the plenum 129. From the plenum, the water flows into a sump 140 and is drawn up by a pump 141 and flows through a check valve 139 and is injected it into the scrub water tank 93. The injection port 142 into the scrub water tank 93 penetrates the scrub water tank wall 144 at approximately the midpoint of the tank 93. The scrub water in the tank 145 is cleaned by stratification of the pollutants washed from the exhaust gases. Heavy mineral fines 147 settle to the bottom of the tank where they may be cleaned out by the fines clean-out port 148. Lighter asphaltic particles 149 float to the surface of the scrub water 145 in the wash water tank 93 where they may be cleaned out at an asphalt clean-out 151.

The wash water supply 152 is taken from the bottom of the tank 93 between the wash water injection port 142 and the fines clean out port 148. The wash water which has been clarified by settlement in the tank 93 flows from the wash water supply to the wash water supply pump 153 as indicated by arrows 155. Water from the wash supply pump flows to a splitter 156 to the left flat stack scrubber 157 and the right flat stack scrubber 158 shown in FIG. 3 and 5. The wash water flows to the spray bar 135 spaced within the scrubber exhaust 133. The water also flows to a drip bar 160, which is positioned along the exterior side 162 of the flat stack scrubber 84 near the exhaust 163. The flow of water into the drip bar 160 is controlled by a solenoid 165 which is controlled by a float valve 166 disposed within the scrub water tank 93. Condensation from the exhaust gases are constantly adding volume to the tank water 145. The float sensor 166 detects when the scrub water tank 93 is full and actuates the solenoid 165 which allows wash water to flow from the wash water supply pump 153 to the drip bar 160. The drip bar 160 drips water along the exterior surface 162 of the flat stack scrubber 84 where it is evaporated by heat flowing through the exterior wall 162 of the scrubber. Water which does not evaporate is collected by a tray 167 and flows through a drain 168 to a sump 140 where it is recirculated to the wash water tank 93.

The flat stack scrubber system 130 of the asphalt plant apparatus 10 results in the release of exhaust gases into the atmosphere which have been scrubbed of particulate asphalt fines and dust thus greatly reducing any atmospheric pollution from the plant apparatus 10. Furthermore, because of the flat stack configuration which is integrated with the heating chamber 12, the asphalt plant apparatus 10 of this invention does not require the employment of any secondary vehicles or air pollution control apparatus in conjunction with the asphalt plant. This results in lower cost and simplifies the use at fixed sites of the asphalt plant apparatus 10. In the mobile application of the asphalt plant apparatus, the use of integrated flat stacks for exhaust cleaning is advantageous in achieving cost effective pollution control because the integrated flat stacks eliminate the need for an entire pollution control vehicle in the paving train.

The asphalt plant apparatus 10 of this invention achieves improved thermal efficiency and reduced exhaust emissions through introducing control over the many variables involved in the manufacture of asphalt paving with a plant apparatus 10. The process control and sensor feedback which form an integral part of the plant apparatus allow for the use of a computer control system which can optimize the asphaltic aggregate preparation process for a particular feed material to achieve a desired output product with improved uniformity over existing asphalt plants. Many variables may be controlled to achieve the objectives of better process control, which improves thermal efficiency and minimizes pollution. Computer control allows the plant apparatus 10 to be automatically reconfigured with changing material feeds and changing material requirements.

The angle of the drum may be controlled by the front hydraulic cylinder 89 in the tractor hitch 87 and the rear hydraulic jack 85 for mobile applications or by the front hydraulic cylinder 89 and the jack 88 for fixed use. The slope of the drum and the rate at which the drum 11 rotates are the two factors which control the rate at which material moves through the drum 11. The rotation rate is controlled by the transmission 16 between the drive motor 15 and the drive sprocket 19 on the drum 11. As the drum 11 rotates, the lifting flights 33 pick up and drop the asphaltic aggregate 25 which cascades to the bottom of the drum 35 and the quadrant plates 39 and in falling is displaced toward the rear of the drum 53.

Total heat supplied to the asphalt plant apparatus 10 is controlled by pulsing on and off the zonal burners 75. The rate at which heat is supplied by the drum and the air within the chamber 12 is controlled by the aspect angle of the burners 75 which is controlled by the angle address control system 78. Feedback for controlling the temperature of the drum and the temperature of the gases within the chamber 12 within a particular heating zone is provided by drum heat sensors 103 and chamber sensor 104, shown in FIG. 1B. Flame on/off sensors 79 provide feedback on which burners are pulsed on or off to the control system 106. The asphalt exit temperature sensor 169 provides the temperature of the aggregate as it leaves the apparatus 10. The exit temperature of the asphalt aggregate is used to adjust the heat input and/or the material 25 throughput to achieve a constant output material temperature which is preferably in the range of 250° to 350° F. and will preferably never exceed 375° F.

The preferred embodiment of the apparatus 10 of this invention will have thermal sensors within the asphalt tank 97 which control the baffles 98 to keep the asphalt or rejuvenating liquids at the desired spray temperatures. The dampers or louvers at the air inlets of the blowers, not shown, control the air pressure and air velocity within the chamber 12. Since the air inlets are preferably driven by electrical actuators, they can be made responsive to the material feed rate and the thermal input to the asphalt plant apparatus 10.

Because the material flow of the plant apparatus of this invention may be placed under computer control, the material output rate may be adjusted over short time periods to compensate for interruptions of material supplied to the drum 11 or the need for more or less paving material on the roadway.

It is important to note that although the zonal heaters 75 burn a clean fuel such as oil or propane, dirty fuel such as waste pellets or coal could be burnt on a grate disposed along the length of the drum 11. Furthermore, a dirty fuel could be burned at one or more burners, such as at the second and third burners, with the remaining burners burning clean fuel. When employing solid fuels which leave residuals such as cinders or ash, the dirty fuel should be supplied by an auger or other mechanism to prevent the escape of heating chamber gases and the ash or cinders would be removed by a similar mechanism.

Also, a single large burner may be employed using ducts controlled by dampers to heat particular zones.

It should be noted that the flat stack scrubbers may not be required every application depending upon the material processed and the fuel burnt and the air pollution abatement requirements of a particular locale. The emissions from the asphalt plant apparatus of this invention will be low compared to a conventional asphalt plant even without the flat stack scrubbers.

It should further be noted because of the high temperatures associated with the heating chamber 12 electrical motors such as the drum mixer drive motor 15 will be thermally insulated from the heating chamber 12.

It is understood that where quadrant plates are shown and described the number of sections into which the drum is divided may be varied but will preferably be an even number. For instance, a single plate bisecting the drum would have some beneficial effect in increasing the material load carrying capabilities of the drum and the use of three or four plates dividing the drum would achieve the advantages of higher throughput and smaller center of gravity offset of the asphalt aggregate plant 10 of this invention.

Although the burners are illustrated as circular type burners, any type of burner may be employed. The preferred burners will be those with large thermal output which may be mounted pivotally so that the angle of impingement of the flame can be adjusted.

Although the burners are illustrated and described as discrete, it should be understood that a single linearly extending burner which has individual zones which can be turned on and off could be employed. It should further be understood that where the burners are shown pivotally mounted, they may be mounted at a fixed angle to achieve an asphalt plant incorporating the advantages of this invention.

It should also be understood that a single burner fired axially beneath the drums could be employed with a series of movable flame deflectors which could produce the heating zones of this invention.

Although the heating chamber is described and illustrated as an insulated structure surrounding the rotating drum, it could consist of an inner and outer wall forming a narrow angular tank which surrounds the heating zone and which would preheat asphaltic material stored within the annular tank.

Because of the efficiency of heat transfer through the surface of the drum and by means of the fins, in a typical application, if the drum is 50 feet long, only approximately 30 feet of the drum would be required for transfer of heat from the burners in the heating zone 74 and approximately 20 feet of the drum could then be used as a preheat zone or condensing zone 72 where latent heat from evaporated water moisture can be recovered from the exhaust gases of the drum.

For purposes of heat transfer, the drum should be made of a heat conducting material. However, although aluminum or copper lined with stainless steel would be preferred for the construction of the preheat drum section, these metals are not preferred for the second chamber or heat chamber drum as too rapid transfer of heat through the material would subject the asphaltic material within the drum to temperatures in excess of 375°, which would produce charring of the asphalt. Materials such as steel, which is cost effective, and stainless steel, which resists oxidation, are in the proper range of thermal conductivity such that heat may readily pass by conduction from the fins and the burners and the chamber air into the interior of the drum, but not pass so rapidly as to overheat the asphalt associated with the asphaltic aggregate being produced.

Because the fins 68 serve as thermally conducting conduits of heat to the drum exterior 20 it is important to fasten them to the drum in such a way as to produce a good thermal path between the fin and the drum. This can be accomplished through intimate bonding to the drum surface 20 such as the bond produced by brazing-/welding and the like. If the fins are bolted or spot welded to the drum, good thermal conductivity can be assured by the employment of a silicon grease designed for high temperature heat applications.

It is understood that the invention is not confined to the particular construction and arrangement of parts herein illustrated and described, but embraces such modified forms thereof as come within the scope of the following claims.

I claim:

1. An apparatus for manufacturing an asphalt paving composition comprising:

a) a cylindrical drum rotatable about a longitudinal axis and having portions defining a material inlet at one end of the drum and a material outlet at the opposite end of the drum, and the drum having portions defining a cavity therein adapted to permit the passage of material and exhaust gases through the drum in a counterflow relationship;

b) a heating chamber enclosing the material outlet end of the drum and at least a majority of the axial length of the drum; and c) a heat source located within the heating chamber and adapted to heat the drum and which generates heated exhaust gases, wherein the heating chamber is adapted to direct heated exhaust gases into the material outlet of the drum and the chamber is substantially sealed to prohibit the escape of exhaust gases, such that substantially all the exhaust gases are directed into the enclosed material outlet and escape through the material inlet of the drum where the gases are exhausted to the exterior of the apparatus.

2. The apparatus of claim 1 wherein the cylindrical drum is divided along its axis by two plates passing through the axis of the cylinder and dividing it into four equal sections, so increasing the load-carrying capability of the drum and reducing the center of gravity offset from the axis of symmetry when the drum is loaded with asphaltic aggregate.

3. The apparatus of claim 1 wherein the plates which passes through the axis of the cylinder have portions defining drop slots adapted to permit asphaltic aggregate compositions to pass from one section to another.

4. The apparatus of claim 3 wherein the drop slots in one plate are offset from the drop slots in an adjacent plate so slowing the passage of material through the cylindrical drum.

5. The apparatus of claim 1 wherein the heating chamber has an interior surface, an exterior surface and insulating material disposed between the interior surface and the exterior surface.

6. The apparatus of claim 1 further comprising a frame supported on wheels for vehicular movement over a ground surface, the frame supporting the heating chamber and the rotatable cylindrical drum therewithin.

7. The apparatus of claim 1 further comprising:

a) a drive sprocket located circumferentially around and outside of the drum;

b) a transmission sprocket engaged with the drive sprocket; and c) a motor adapted to drive the drive sprocket to rotate the drum.

8. The apparatus of claim 1 further comprising a spray bar disposed within the drum proximate to the material inlet end of the drum for adding asphalt or a rejuvenating agent to the material.

9. The apparatus of claim 1 wherein the heat source comprises a plurality of heaters mounted to the heating chamber and spaced axially along the chamber such that the heaters are directed towards the drum and wherein the heater are selectively operable to control the amount of heat supplied to the drum.

10. The apparatus of claim 9 further comprising a plurality of baffles spaced between the heaters and affixed to and spaced axially along the heating chamber, the baffles extending transverse to the axis of the drums and spaced from the exterior of the drum, forming a plurality of heating zones within the chamber for controlling the heating of the drum along its axis.

11. The apparatus of claim 9 wherein the heaters are adapted to produce a flame and are rotatively mounted to the frame with an axis of rotation parallel to the axis of the drum, wherein the heaters are controllably rotatable so as to change the impingement angle of the flames on the drum surfaces.

12. The apparatus of claim 11 further comprising:

a) a heater on/off sensor;

b) a plurality of indirect thermal sensing devices mounted in spaced from the axis of the heating chamber for monitoring the temperature of the cylindrical drum;

c) a temperature sensor located proximate the material outlet and adapted to measure the temperature of asphaltic material leaving the heating chamber;

d) a heater impingement angle sensor adapted to detect the angle which the heaters are directed at the drum; and e) a programmable controller receiving inputs from the indirect drum sensors, the material outlet temperature sensor, the heater on/off sensor, and the heater impingement angle sensor, and sending outputs to control the heaters and their impingement angle according to a programmed control logic for producing asphaltic material in the range of 250° to 350° F.

13. The apparatus of claim 1 wherein the cylindrical drum has a multiplicity of metallic fins spaced and attached to its outer surface for conducting heat into the drum and for maintaining a turbulent environment within the heating chamber.

14. The apparatus of claim 13 wherein the fins are at an acute angle with respect to the axis of the cylinder so as to move the gases within the heating chamber toward the gas inlet of the rotating drum.

15. The apparatus of claim 1 wherein the heating chamber substantially surrounds the entire drum and has a baffle separating the chamber surrounding the cylindrical drum into a first section and a second section, the first section being located near the material inlet end of the cylindrical drum, and the heat source is located within the second section defined by the heating chamber and the baffle, and the second section substantially encloses the material outlet end of the cylindrical drum.

16. The apparatus of claim 15 further comprising:

a) a blower;

b) a duct extending from the top of the first section of the heating chamber and disposed towards the material inlet end of the heating chamber and further extending to the blower; and c) a pipe connecting the blower to a burner, wherein the blower is adapted to move gases from the top of the first section near the material infeed end of the heat chamber to at least one burner for combustion.

17. The apparatus of claim 15 further comprising:

a) portions of the heating chamber bottom within the first section near the material infeed end of the heating chamber which define a depression in the heating chamber bottom for collecting water and fines; and b) an auger rotatably mounted within the depression and communicating with the exterior of the apparatus and adopted to remove fines and drain water from the heating chamber.

18. The apparatus of claim 15 further comprising a feed hopper disposed at the material inlet end of the heating chamber and cylindrical drum, wherein the feed hopper has a vane seal forming a one-way passage of materials into the heating chamber and the cylindrical drum and preventing gases from escaping through the hopper.

19. The apparatus of claim 15 wherein the heating chamber is composed of sufficient metal and has sufficient screenings about all openings so as to form a microwave shield, and further comprising a microwave waveguide mounted on the interior face of the rear discharge end of the heating chamber, the waveguide being aimed so as to direct microwave energy into the discharge end of the cylindrical drum.

20. The apparatus of claim 15 wherein the heating chamber walls are made of material resistant to the penetration of sound, further comprising a transducer affixed to the material discharge end of the heating chamber and spaced from the discharge opening, the transducer adapted to produce and direct sound into the cylindrical drum to clean the drum and improve heat transfer to the material in the drum.

21. The apparatus of claim 15 wherein the side walls of the heating chamber have portions defining at least one gas passages extending from the first section located near the material inlet end of the heating chamber, and further comprising a flat scrubber stack having a narrow trapezoidal box disposed along a side of the heating chamber.

22. The apparatus of claim 21 wherein the flat stack scrubber has a side adjacent to the heating chamber and a side opposed to the heating chamber and having a top, a bottom, a first end plate and a second end plate, the adjacent side having a hole which communicates with the hole in the side of the heating chamber, the hole being located near the bottom of the flat stack;

a) a plenum defined by the bottom and lower portions of the adjacent side opposed side, first end, second end and a plenum outlet spaced between the side adjacent and side opposed, the plenum outlet having holes for the uniform exhaustion of the heating chamber gases into the flat stack;

b) the top of the flat stack further having openings for the venting of the heating chamber gas:

c) a scrubber spray bar penetrating the flat stack from end to end and disposed near the top for spraying water over the gases rising from the plenum;

d) an evaporator drip line extending the length of the flat stack and positioned adjacent to the opposed side and the top of the flat stack for dripping water down the opposed side, the evaporation therefrom cooling the flat stack;

e) a trickle-down pan collector affixed to the bottom of the opposed side of the flat stack scrubber for collecting unevaporated drip-bar water:

f) a sump communicating with the trickle-down pan collector and the bottom of the flat stack:

g) a pump connected to the sump removing water from the flat stack;

h) a scrub-water tank, the tank having a top, a bottom, and sidewall, the sidewall having an asphalt cleanout port spaced from the top of the tank, and a fines cleanout port spaced from the bottom of the tank, and having an inlet from the pump spaced from the bottom and the top and having a water outlet spaced between the bottom cleanout and the water inlet;

i) a float sensor spaced from the top of the tank for sensing the level of fluids within the tank;

j) pipe between the water outlet of the tank and the spray bar, drip line and over an overflow line.

23. The apparatus of claim 1 further comprising a discharge spray bar spaced within the outlet end of the cylindrical drum for adding asphalt or rejuvenating agent to the discharged material.

24. The apparatus of claim 1 further comprising:

a) a gas bottle;

b) a quantity of halon gas disposed within the gas bottle, the gas bottle being affixed to the exterior of the heating chamber, wherein the gas bottle is connected with the interior of the heating chamber, where the halon gas may be selectably introduced into the interior of the heating chamber to extinguish a fire within the heating chamber.

25. An apparatus for producing asphalt-aggregate compositions comprising:

a) an elongated, rotatable cylindrical drum, having a cavity therein, the drum having a material inlet end and a material discharge end;

b) a heating chamber enclosing and substantially surrounding the rotatable drum, wherein the drum is rotatably mounted within the heating chamber and the heating chamber has portions defining a material inlet proximate to the material inlet end of the cylindrical drum, and the chamber has portions defining a material outlet proximate to the material outlet end of the drum; and c) a plurality of heaters mounted to the heating chamber and spaced axially along the chamber such that the heaters are directed towards the drum and wherein the heaters are selectively operable to control the amount of heat supplied to the drum.

26. The apparatus of claim 25 wherein the heaters are of the type which produce a flame and the heaters are rotatively mounted to the heating chamber and wherein the impingement angle between the heater flame and the drum surface is variable by rotating the heaters.

27. The apparatus of claim 25 wherein the material inlet and the material outlet of the heating chamber are of the type employing a seal for preventing the outflow of gases therefrom, and the heating chamber further comprises:

(a) a baffle transverse to the axis of the drum and dividing the heating chamber into two section, the first section being disposed near the material infeed end of the drum and the second section is disposed near the outfeed end of the drum wherein the multiplicity of heaters are located at the second section; and (b) an air feed to the heaters in the second compartment of the heating chamber and an air outlet in the first compartment of the heating chamber so that the flow of air through the heating chamber from the blower to the outlet is through the cylindrical drum in counterflow to the material flowing through the drum.

28. The apparatus of claim 25 wherein a plurality of heaters are mounted axially to the heating chamber spaced from the drum, and thermal baffles which are attached to the heating chamber between the heaters to separate the burners from each other and to direct the heat generate from each heater onto a particular zone of the drum.

29. An apparatus for producing asphalt-aggregate compositions comprising:

a) an elongated, rotatable cylindrical drum, having a cavity therein and a wall at each end thereof, the cylinder having an axis of symmetry about which it is rotatable and having at least one plate intersecting the cylinder and passing through the axis of the cylinder so dividing it into two or more sections, the rotatable cylindrical drum having a material inlet at one end and a material outlet at the opposite end through which asphaltic-aggregate compositions delivered to said material inlet passes and is discharged through said material outlet;

b) a frame to which the drum is rotatably mounted; and c) a heater affixed to the frame to direct heat to the contents of the drum.

30. The apparatus of claim 29 wherein the cylindrical drum is divided along its axis by two plates passing through the axis of the cylinder and dividing it into four equal quadrants, so increasing the load-carrying capability of the drum and reducing the center of gravity offset from the axis of symmetry when the drum is loaded with asphaltic aggregate.

31. The apparatus of claim 29 wherein the plate which passes through the axis of the cylinder so dividing it into at least two sections has portions defining drop slots adapted to permit asphaltic aggregate compositions to pass from one section to another.

32. The apparatus of claim 31 wherein the drop slots in one plate are offset from the drop slots in an adjacent plate so slowing the passage of material through the cylindrical drum.

33. The apparatus of claim 29 wherein the cylindrical drum has portions defining a cylindrical chamber between the material inlet end of the cylindrical drum and the portion of the drum having the plates.

34. The apparatus of claim 33 further comprising cupped fill flights affixed to the ends of the two plates and the surface of the drum at the infeed end of the drum for aiding and filling the sections.

35. The apparatus of claim 29 wherein the cylindrical drum has portions defining a cylindrical chamber between the material outlet end of the cylindrical drum and the portion of the drum having the plates, said cylindrical portion having lifting flights for mixing the material and lifting it for discharge; unloading flights disposed within the discharge end of the cylindrical drum for receiving and discharging material onto a drop chute, the drop chute having a hinged, spring-loaded, drop chute seal disposed at the end of the drop chute for passing materials out of the heating chamber and sealing in the heating gases therein.

36. An apparatus for producing asphalt-aggregate compositions comprising:

a) an elongated, rotatable cylindrical drum, having a cavity therein and a wall at each end thereof, the cylinder having an axis of symmetry about which it is rotatable and having at least one plate intersecting the cylinder and passing through the axis of the cylinder so dividing it into two or more sections, the rotatable cylindrical drum having a material inlet at one end and a material outlet at the opposite end through which asphaltic-aggregate compositions delivered to said material inlet passes and is discharged through said material outlet, the rotatable cylindrical drum having a gas inlet on the end containing the material outlet, and a gas outlet on the end containing the material inlet and adapted to allow gas movement in counterflow to the flow of material throughout the drum;

b) a heating chamber enclosing and surrounding the rotatable cylindrical drum comprising a top, a bottom, two sides and an inlet end and outlet end, wherein the rotatable drum is spaced within the heating chamber and has its material inlet end spaced from the chamber inlet end and the drum has its material outlet end spaced from the chamber outlet end;

c) a plurality of heaters affixed to the heating chamber aligned with and spaced from the axis of the cylindrical drum.

* * * * *